US006669583B1

(12) United States Patent
Deppen

(10) Patent No.: US 6,669,583 B1
(45) Date of Patent: Dec. 30, 2003

(54) PADDLE BALL GAME

(76) Inventor: Daniel L. Deppen, 22106 Clarendon St. Ste. 250, Woodland Hills, CA (US) 91367

( * ) Notice: Subject to any disclaimer, the term of this patent is extended or adjusted under 35 U.S.C. 154(b) by 0 days.

(21) Appl. No.: 10/170,853

(22) Filed: Jun. 12, 2002

(51) Int. Cl.[7] ..... A63B 67/00
(52) U.S. Cl. ..... 473/474; 473/473; 473/415
(58) Field of Search ..... 473/415, 473, 473/474, 475, 465

(56) References Cited

U.S. PATENT DOCUMENTS

| | | | | | |
|---|---|---|---|---|---|
| 1,699,660 | A | | 1/1929 | Forrest | |
| 2,163,456 | A | | 6/1939 | Youngberg | |
| 3,393,913 | A | * | 7/1968 | Safina | 273/118 R |
| 3,671,040 | A | * | 6/1972 | Meyer et al. | 473/473 |
| 3,968,968 | A | | 7/1976 | Peterson | |
| 3,980,299 | A | | 9/1976 | Brown | |
| 4,248,428 | A | | 2/1981 | Vilches | |
| 4,270,757 | A | | 6/1981 | Ligon | |
| 4,336,942 | A | | 6/1982 | Warehime | |
| 4,355,813 | A | | 10/1982 | Rathjen | |
| 4,373,734 | A | | 2/1983 | Frank | |
| 4,457,513 | A | | 7/1984 | Thompson | |
| 4,523,762 | A | | 6/1985 | Garner, Sr. | |
| 4,819,947 | A | | 4/1989 | Mackey | |
| 4,834,392 | A | | 5/1989 | Nixon | |
| 4,880,243 | A | | 11/1989 | Raub | |
| 4,962,935 | A | * | 10/1990 | Williams | 473/474 |
| 4,979,754 | A | * | 12/1990 | Eisenhart | 473/474 |
| 5,002,284 | A | | 3/1991 | Butler et al. | |
| 5,072,947 | A | | 12/1991 | Blue | |
| 5,112,061 | A | | 5/1992 | Lamle | |
| 5,123,655 | A | | 6/1992 | Rones | |
| 5,303,932 | A | | 4/1994 | Kessler | |
| 5,584,487 | A | | 12/1996 | Blue | |
| 5,615,890 | A | | 4/1997 | Blue | |
| 5,630,589 | A | * | 5/1997 | Adie et al. | 473/474 |
| 5,692,980 | A | * | 12/1997 | Trotman | 473/473 |

* cited by examiner

*Primary Examiner*—Raleigh W. Chiu
(74) *Attorney, Agent, or Firm*—James G O'Neil; Klein, O'Neill & Singh, LLP

(57) ABSTRACT

A game is played by providing at least two hitting devices, a resilient projectile and at least two eight foot squares spaced twelve feet apart on a sand or grass surface. Two or four players hit the resilient projectile back and forth between opposed or diagonal squares until a mistake is made by a player. If the mistake is made by the non-serving player or team, the serving player or team is awarded a point. If the mistake is made by the serving player or team, the non-serving player or team gets to serve. Play is continued until a game is won by at least two points by the player or team to first reach 21 or higher. One or more sets of games may also be played.

13 Claims, 2 Drawing Sheets

PADDLE BALL GAME

BACKGROUND OF THE INVENTION

1. Field of the Invention

This invention relates generally to a game and method of playing the same, and more particularly to a game that would be played at a beach, or on a lawn, or in a yard using special marked off areas and a ball and paddles, in accordance with specific rules of play and scoring.

2. Description of Related Art

Various prior art games are well known, but they tend to be relatively complicated and require knowledge and/or skills beyond that of a normal player.

Handball, racquetball and tennis are examples of such games, played on a marked court and requiring a player to make decisions as to whether and where a ball should be played or returned. Each of these known games has specific rules for playing the game.

Applicant is also aware of a number of games protected by U.S. Patents, such as U.S. Pat. Nos. 2,163,456, 4,248,428, 4,270,757, 4,355,813, 4,523,762, 4,834,392, 4,880,243, 4,979,754 and 5,002,284. These patents disclose apparatus, games or methods for players to play various games on surfaces and/or marked-off areas. However, the known apparatus, games and methods are markedly different than the present invention.

SUMMARY OF THE INVENTION

It is a general object of the present invention to provide a new game playable by two or four players on a sand or grass surface. It is a particular object of the present invention to provide a new game playable with paddles and a special ball, wherein the players must stay in marked-off squares spaced 12 feet apart on a sand or grass surface. And, it is a further particular object of the present invention to play a game in which players utilizing hitting devices hit a projectile back and forth between eight foot squares, spaced twelve feet apart, marked-off on a sand or grass surface, until a winner is determined by the player or players making the fewest mistakes during a single game or a set of games.

The game of the present invention is played by marking off or staking out two or four areas utilizing special circles and ribbons. The marked-off or staked out areas are rectangles placed approximately twelve (12) feet apart, preferably eight foot square and parallel to each other. The special circles forming the corners of each square are held down by being wedged in sand when playing on a beach or other sandy surface, or by a golf tee or other securing element when playing on grass. Other surfaces may, of course, be played on, but best results are obtained when playing on sand or grass.

A special ball or projectile is used of the type that may be hit by a paddle, racquet or other type hitting device, and which projectile does not bounce when it hits sand or a grass surface.

If two players are to play the game, 2 squares are marked-off, while if 4 players are to play 2 sets of adjoining eight foot squares are formed 12 feet apart.

The object of the game of the present invention is to hit the ball into an opposite square (if 2 players) or a directly opposite or diagonally opposite square (if 4 players) and for the opposite or diagonally opposite player to return the ball into the square from which the ball was hit, or a diagonally opposite square. The challenge is how many times the players can hit the ball back and forth without making a mistake. To aid in playing the game, no fast ball serving is permitted, so as to allow the ball to get into play.

The game starts by a volley to serve, when any one of the players serves the ball to another player in an opposite or diagonally opposite square. Then after the ball is hit at least 3 times in a row, the first player to make a mistake allows the opposite, or one of the opposite, players to serve. The serve may be done over or under hand but cannot be fast.

After the serve and during play, with 2 players and 2 squares, the players hit the ball back and forth into the opposite square. If the non-serving player does not return the ball the server is awarded a point. Or, if the non-server hits the ball into the opposite square and it is not returned by the server, then the non-server gets to serve. Play continues until a player reaches 21 points, provided that a win must be by two points, for example 21 to 19. The winning player can also be determined by a set. That is, the first player to win three games wins the set. When playing by the set, the players change sides after each game in the set.

When four players are playing, in sets of two squares beside each other which form one large rectangle (8'×16'), spaced 12 feet apart, each pair of players stays in her or his own rectangle and can only return a ball which enters such rectangle. All other game rules apply, except that two game sets are required to be played by the four players.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DETAILED DESCRIPTION OF THE PREFERRED EMBODIMENTS

Figure 1:
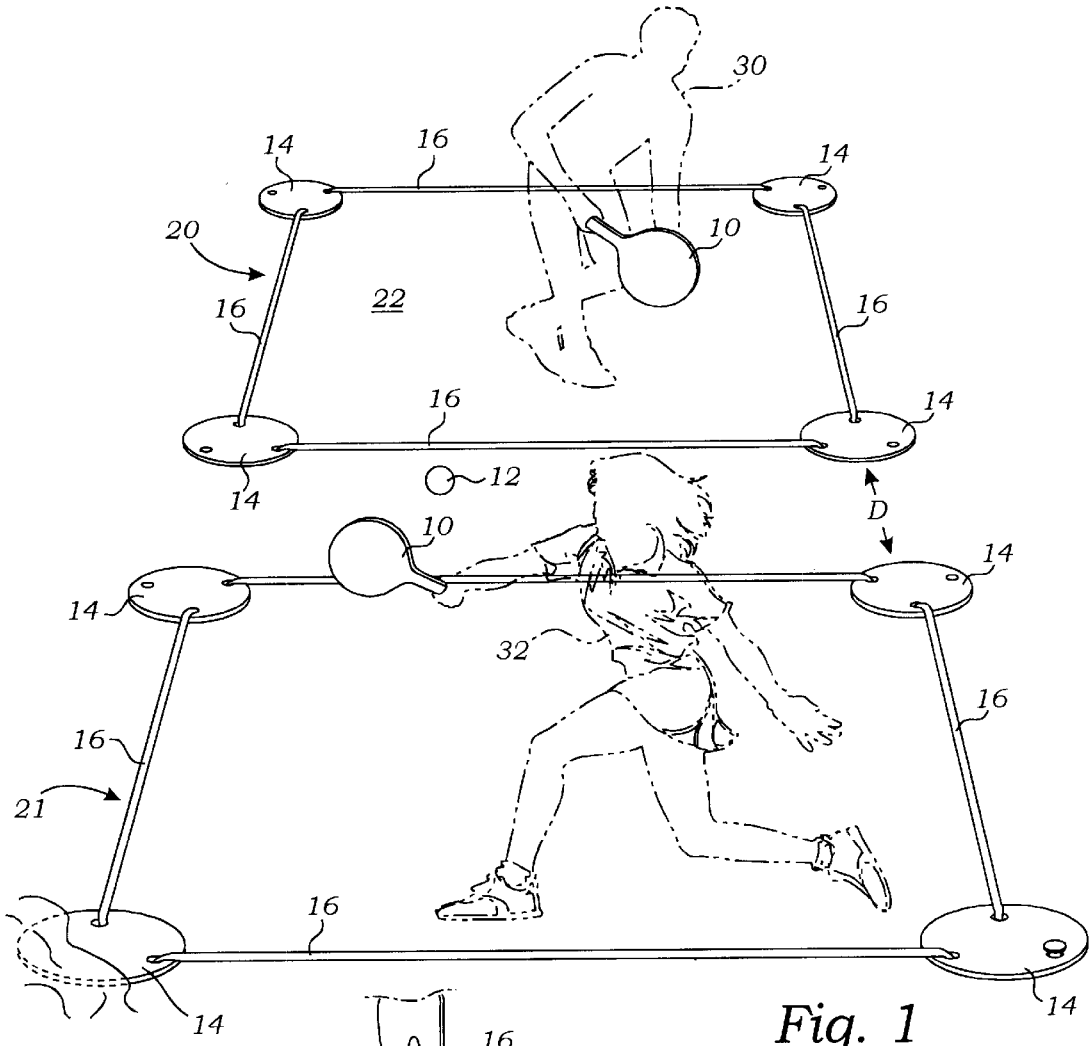
FIG. 1 is a perspective, schematic view showing the elements of the game of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved game and method of playing. Although the present invention may be utilized on any surface 22, it is described as used on the preferred surfaces of sand and grass.

There are but four (4) components or pieces of equipment that are needed to play the game of the present invention. These components comprise: 1. at least two paddles, racquets or other hitting device 10, 2. at least one (1) resilient projectile or ball 12, 3. at least eight (8) circles or corner markers 14, and 4. a number of ribbons or strings 16 of a predetermined length. Additionally, a number of golf tees or some other type of securing elements 18 for securing the corner markers should be used when playing the game of the present invention on grass.

Figure 2:
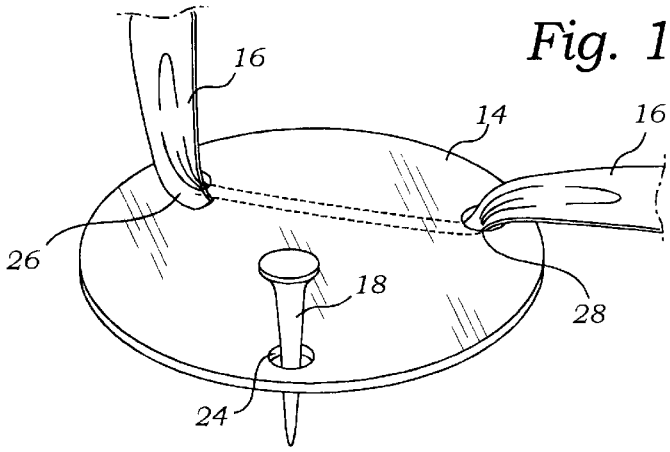
FIG. 2 is a perspective view of a corner circle and ribbon of the present invention.

As shown in FIG. 1 using the corner markers 14 and ribbons or strings 16, two playing squares 20, 21, preferably eight feet on a side, are formed by tying ribbon 16 to 4 circles or corner markers 14 and placing the 4 circles on the surface 22, to mark the four corners of each playing square. The playing squares 20, 21 are placed approximately twelve (12) feet apart and parallel to each other with no net barrier therebetween. That is, a space is provided in lieu of a net barrier. The corner markers 14 may be of any desired size or shape, and may have indicia or logos printed therein. If used on sand, the corner markers 14 are preferably partially buried or wedged in place. Or, if the corner markers 14 are placed on grass, they are preferably held in place by one or more golf tees or other securing elements 18, inserted through at least one aperture 24, formed in the corner marker 14. Second and third apertures 26, 28 formed in the corner markers 14 are used to insert and secure, as by tying, one end of a ribbon or string 16 (see FIG. 2) preferbly of a size and color so that it may be clearly seen on a playing surface.

The object of the game is for a person 30, 32 to hit the ball or projectile 12 with a paddle, racquet or other hitting device from one square, such as 20, to the opposite square, such as 21, and for the person in the opposite square 21 to return the ball to square 20. Each player 30, 32 tries to hit the ball back to the other square without making a mistake, such as missing the ball or missing the square.

Rules of Play and How to Keep Score

The game may be played by two players in two different ways—by the game or by the set. If by the game, the first player to reach 21, provided the player has two points more than her/his opponent, will win. Therefore, scoring can exceed 21 in some games where there is only one point difference, 21 to 20 when the first player reaches 21. The game then continues until one of the players has a two point advantage.

If played by the set, the first player to win three games wins the set. During the set, the players change sides or game squares after each game.

To determine who serves, the players volley for serve. Either of the players hits the ball to the other and after the ball has been hit back and forth at least three times in a row, the first player to make a mistake, for example, hit the ball short or to the side of the opposite square, allows the other or opposite player to serve.

The ball may be served over, side or under hand, provided it is not served too fast. The idea is to get the ball into play.

During play, points may only be scored by the serving player when the serving player hits the ball into or through the front and rear boundary of the opposite square without the opposite player returning the ball. If the opposite, non-serving player makes such a shot that is not returned, then they are awarded the serve. The serving player is awarded one point for such a shot, provided the ball passing through the rear boundary is not out-of-reach of the opposite player. "Out-of-reach" is defined as: if the player receiving the ball were to stand with her/his arm fully extended overhead with their paddle 10 in hand, the ball must not go higher than the paddle. Furthermore, during play, players cannot hit the ball more than once in a row when serving or returning the ball. If the server hits the ball more than once, the server loses the serve. While if the non-serving player hits the ball more than once, the server scores one point.

Figure 3:
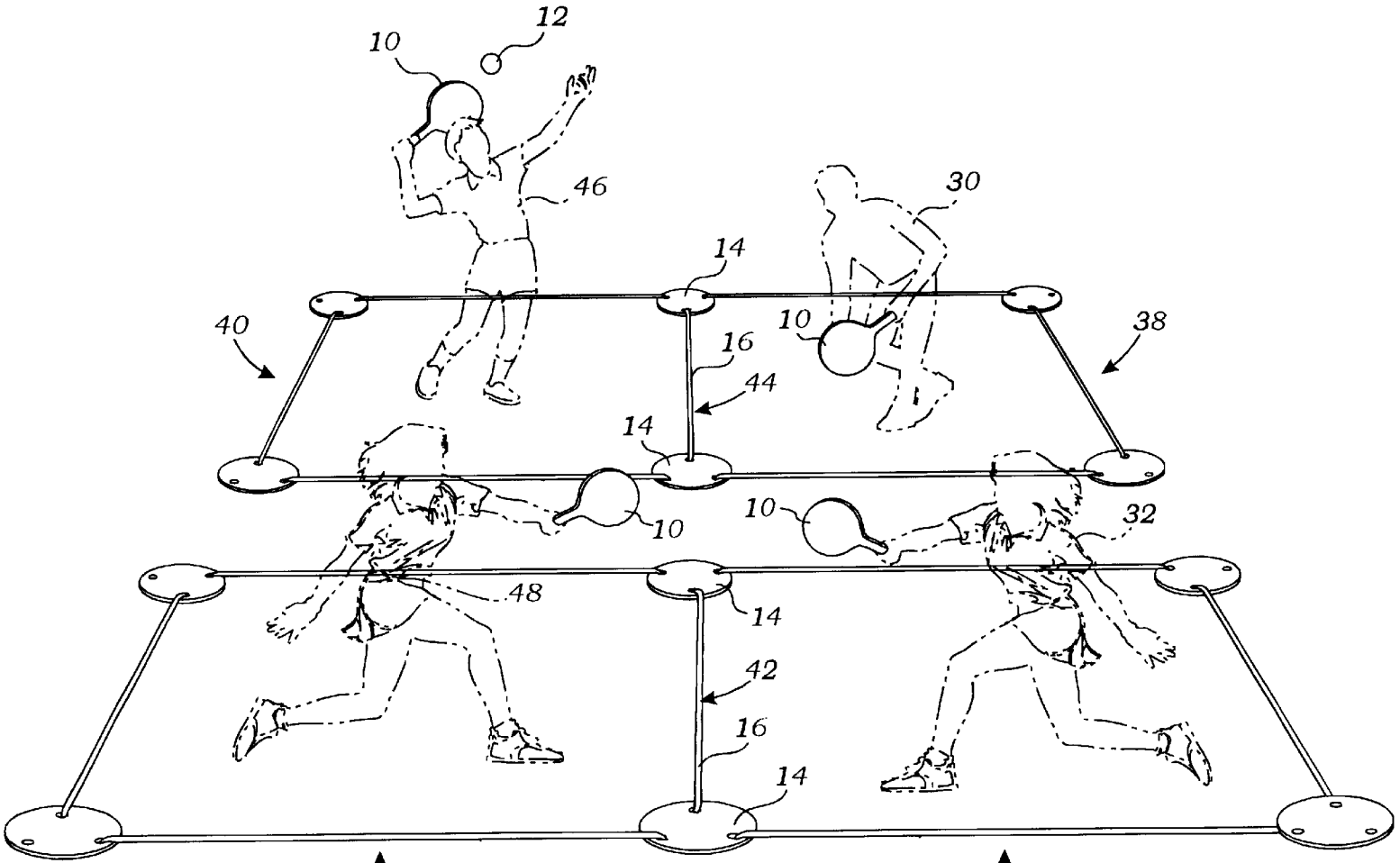
FIG. 3 is a perspective, schematic view showing the elements of the game of the present invention being played by 4 persons.

FIG. 3 illustrates how the game of the present invention is played with four (4) players. The playing area is formed by making four areas 34, 36, 38, 40, consisting of two adjacent playing squares on each side, with each side being separated by twelve feet. Each of the playing squares 34, 36, 38, 40 are eight feet square and formed by placing side boundaries 42, 44 of two adjacent squares, formed by corner markers 14 and ribbon 16, on top of one another. Then two of the players 30, 32, 46, 48 form teams and stay in their own square 34, 36, 38, 40 during play. For illustrative purposes only, the players 30, 32, 46, 48 are shown in various positions of play. Except that the players form teams of 2, that each player may hit the ball 10 to the opposite or a diagonally opposed square, and that two game sets are required to determine a winner, all other rules of the game, as described above, apply.

In summary, only the server, or the serving team if four players, may score a point. If the non-serving player or team hits the ball into or through the opposite or diagonal square, as long as not out-of-reach overhead, the opposite player or team is awarded the serve.

Play continues until a player or team wins a game or game set(s), as explained above.

After play is finished, the ribbon 16 is preferably removed from the corner markers 14 and the elements of the game packed and stored for future use.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A method of playing a game among a plurality of players playing against each other with the ultimate objective of winning the game, including the steps of:

providing at least two squares spaced approximately twelve feet apart on a soft surface with the space formed between the at least two square acting as a net;

providing a player in the at least two square with a hitting device;

providing a resilient projectile;

putting the resilient projectile in play to see which of the players serves to start play;

hitting the resilient projectile back and forth until a player makes a mistake; and continuing playing of the game by the players until a predetermined number of points is reached or a series of games in a set is completed.

2. The method of claim 1 wherein each of the at least two squares are approximately eight feet on a side, and only allowing a serving player to accumulate points.

3. The method of claim 2, including the step of forming the at least two squares by using ribbon held in corner markers, secured into grass or sand.

4. The method of claim 3, including the step of providing four squares in two sets of squares having side boundaries on top of one another forming rectangles, spaced approximately twelve feet apart.

5. The method of claim 4, including the step of providing four players with four hitting devices and limiting each of the four players to playing in an assigned rectangle.

6. The method of claim 1, including the step of forming the at least two squares by using ribbon held in corner markers, secured into grass or sand.

7. The method of claim 6, including the step of providing four squares in two sets of squares having side boundaries on top of one another forming rectangles, spaced approximately twelve feet apart.

8. The method of claim 7, including the step of providing four players with four paddles and limiting each of the four players to playing in an assigned rectangle.

9. The method of claim 8 wherein each of the four squares is approximately eight feet on a side, with adjacent side boundaries of adjoining squares on top of one another to form rectangles approximately 8 feet by 16 feet.

10. A method of playing a paddle ball game including the steps of:

marking off at least two parallel eight foot squares spaced twelve feet apart on a grass or sand surface with no net between the spaced, eight foot squares;

providing a player limited to playing in each square with a paddle;

providing a resilient ball;

putting the resilient ball in play so that it is hit back and forth at least three times to determine which player serves;

allowing the serving player in one of the squares to start the game by hitting the resilient ball to another player in a second of the squares whereby the other player may hit the ball back to the serving player;

hitting the resilient ball back and forth until a player makes a mistake; and continuing playing of the paddle ball game so that each time a non-serving player makes a mistake the serving player is awarded a point, or each time the serving player makes a mistake the non-serving player gets to serve until the point total for a player reaches 21 and is at least 2 points more than that of the other player.

11. The method of claim 10, including the step of forming the at least two parallel eight foot squares by using corner markers placed at corners of each square and tying the corner markers together by ribbon.

12. The method of claim 11 wherein there are four parallel eight foot squares and four players with paddles each player limited to play in an assigned square; and wherein the four players form two teams, one of which two teams serves and the other of which two teams receives the resilient ball.

13. A method of playing a paddle a paddle ball game including the steps of:

marking off four parallel eight foot squares, in sets of two, spaced twelve feet apart on a grass or sand surface with no net between the two sets;

providing a player an assigned square and a paddle so as to form two teams;

providing a resilient ball;

putting the resilient ball in play so that it is hit back and forth at least three times to determine which team serves;

allowing one of the players in the serving team to start the game by hitting the ball to a player in a receiving team whereby the other player may hit the ball back to a player in the serving team;

hitting the ball back and forth until a player makes a mistake; and continuing playing of the paddle ball game so that each time a player in a non-serving team makes a mistake the serving team is awarded a point, or each time a player in the serving team makes a mistake a player in the non-serving team gets to serve until one of the teams reaches 21 points and is at least 2 points ahead of the other team.

* * * * *